US006331033B2

(12) United States Patent
Lau

(10) Patent No.: US 6,331,033 B2
(45) **Date of Patent: *Dec. 18, 2001**

(54) PORTABLE RECLINER ASSEMBLY

(75) Inventor: Kwok-Wing Lau, Hong Kong (HK)

(73) Assignee: Pleasure Time Products (HK) Limited (HK)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/413,583

(22) Filed: Oct. 6, 1999

(51) Int. Cl.[7] ..... A47C 1/02
(52) U.S. Cl. ..... 297/325; 297/248; 297/452.41
(58) Field of Search ..... 297/248, 249, 297/325, 377, 440.14, 232, DIG. 3, 452.41, 272.3, 258.1; 5/655.3

(56) References Cited

U.S. PATENT DOCUMENTS 3,112,956 * 12/1963 Schick et al. .
3,265,438 * 8/1966 Regan et al. .
3,420,574 * 1/1969 Smith .
3,572,836 * 3/1971 Khanh .
4,311,337 * 1/1982 Brunn .
4,423,865 * 1/1984 Mahnke .
4,459,714 * 7/1984 Lin .
4,639,960 * 2/1987 Quillen et al. .
4,932,721 * 6/1990 Anthony .
4,945,587 * 8/1990 Ferro .
4,974,905 * 12/1990 Davis .
5,474,361 * 12/1995 Hwang et al. .
5,628,103 * 5/1997 Ayotte et al. .
5,699,569 * 12/1997 Schwarz-Zohrer .
6,003,946 * 12/1999 Jackson .

FOREIGN PATENT DOCUMENTS

1021956 * 4/1956 (FR) .
690009 * 4/1953 (GB) .

* cited by examiner

*Primary Examiner*—Milton Nelson, Jr.
(74) *Attorney, Agent, or Firm*—Raymond Sun

(57) ABSTRACT

A portable recliner assembly includes a recliner seat having a plurality of spaced-apart first connectors, and a support having a second connector that is selectively coupled to one of the plurality of first connectors. The recliner seat can have first and second side walls, and at least one side connector provided along each of the first and second side walls, with each side connector adapted to couple a side connector from another recliner seat.

17 Claims, 8 Drawing Sheets

PORTABLE RECLINER ASSEMBLY

BACKGROUND OF THE INVENTION

1. Field of the Invention

The present invention relates to portable recliner assemblies that can be used for indoor and outdoor purposes.

2. Description of the Prior Art

There is presently a wide variety of indoor and outdoor furniture. In particular, pool furniture and accessories are especially popular. One common type of pool accessory or furniture is the pool recliner. Most of these pool recliners are either inflatable or provided in a foam material. These pool recliners are very popular because they allow a recreational user to float on the water of a swimming pool while reading or just relaxing.

Many of these conventional pool recliners have a fixed configuration so that the user cannot adjust the angle of the back rest. Therefore, the predetermined angles of some of these back rests can be quite uncomfortable for some users.

In addition, most of these conventional pool recliners are provided with only a single seat, so that it will be very difficult for two users to "float" in a side-by-side or face-to-face manner. For example, two users who want to float side-by-side or face-to-face will need to utilize two separate recliners, but there is no effective way to assure that both recliners will float or move in unison.

Thus, there remains a need for a portable recliner that overcomes the problems associated with the conventional portable recliners, which allows the user to conveniently adjust the angle of the back rest, and which can be conveniently coupled to other portable recliners.

SUMMARY OF THE DISCLOSURE

The objectives of the present invention are accomplished by providing a portable recliner assembly that includes a recliner seat having a plurality of spaced-apart first connectors, and a support having a second connector that is selectively coupled to one of the plurality of first connectors.

In one embodiment, the recliner seat can have first and second side walls, and at least one side connector provided along each of the first and second side walls, with each side connector adapted to couple a side connector from another recliner seat.

DETAILED DESCRIPTION OF THE PREFERRED EMBODIMENTS

The following detailed description is of the best presently contemplated modes of carrying out the invention. This description is not to be taken in a limiting sense, but is made merely for the purpose of illustrating general principles of embodiments of the invention. The scope of the invention is best defined by the appended claims. In certain instances, detailed descriptions of well-known devices and mechanisms are omitted so as to not obscure the description of the present invention with unnecessary detail.

The present invention provides a portable recliner assembly in which the angle of the back rest can be adjusted. The portable recliner assembly of the present invention can also be coupled in a variety of different ways to other portable recliner assemblies. The portable recliner assemblies of the present invention can be used for outdoor recreational purposes, such as at water recreational areas (pools, beaches, etc.), or even for indoor purposes, such as indoor furniture for use by children or adults.

Figure 1:
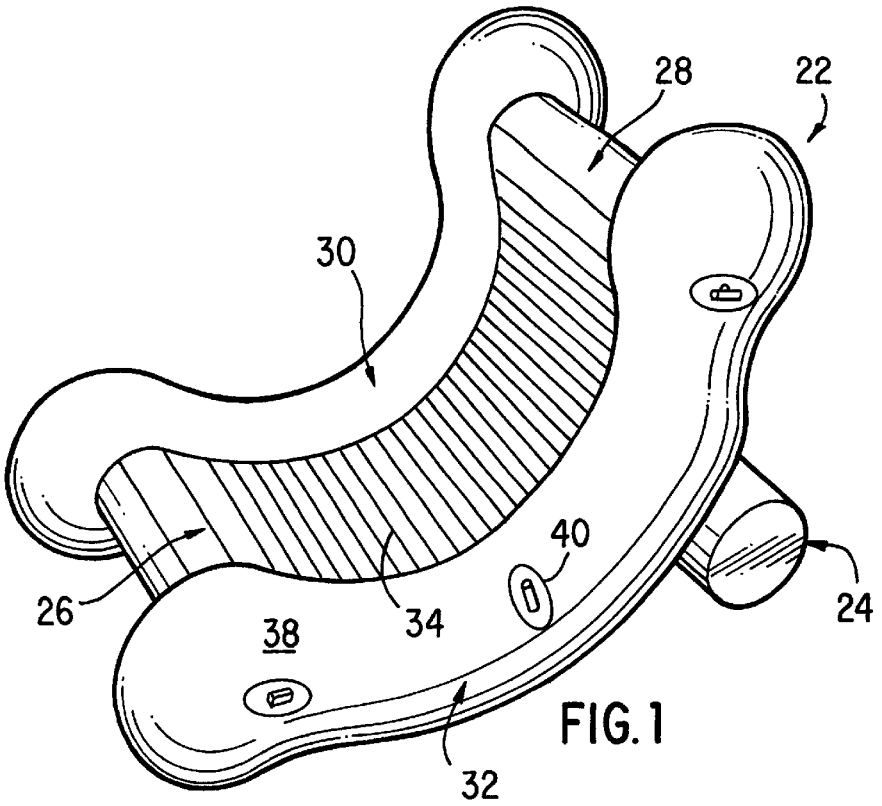
FIG. 1 is a perspective view of a portable recliner assembly according to one embodiment of the present invention.
Figure 3:
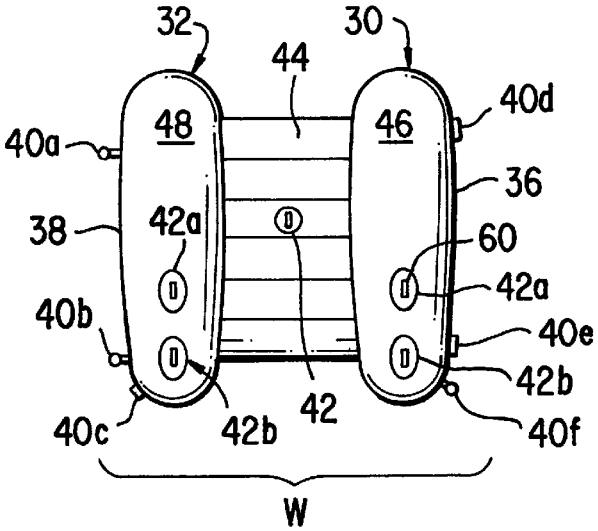
FIG. 3 is a rear plan view of the assembly of FIG. 1.
Figure 4:
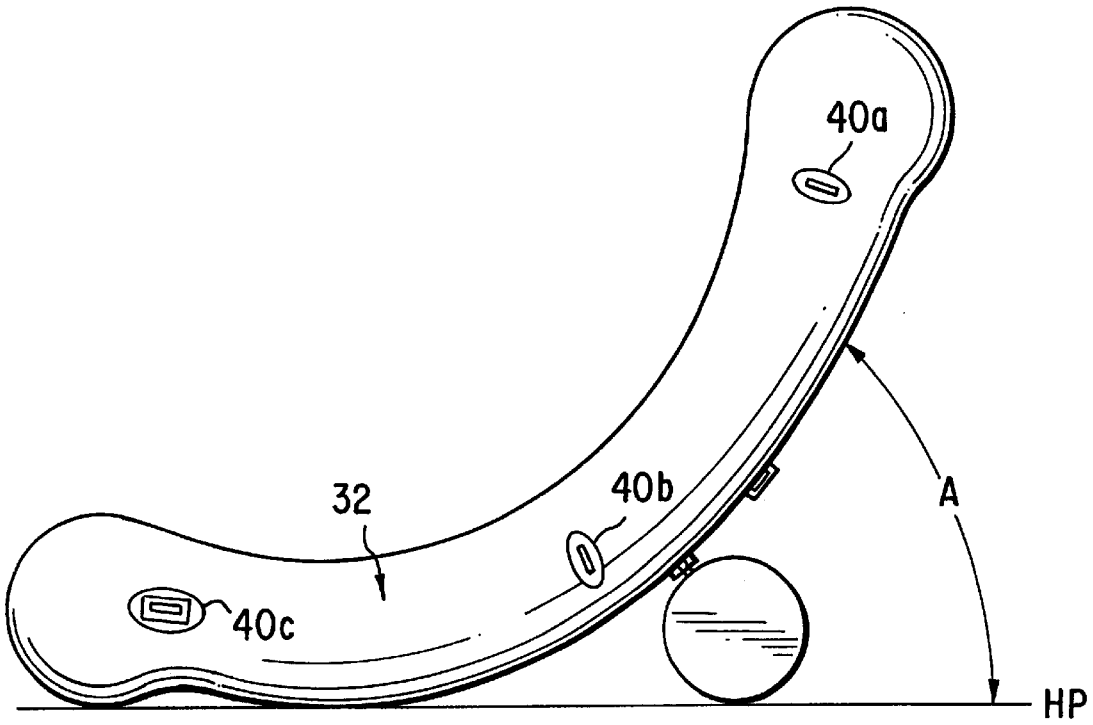
FIG. 4 is a side plan view of the assembly of FIG. 1.

A portable recliner assembly 20 according to the present invention is illustrated in connection with FIGS. 1–4. The assembly 20 is comprised of two basic components, a recliner 22 and a support 24. Referring to FIGS. 1, 3 and 4, the recliner 22 has a seat portion 26, a back rest 28, and two side arm rests or borders 30 and 32 that are preferably formed in a single piece. The recliner 22 can be formed from one integral piece of foam or other similar material that has sufficient buoyancy to float. Alternatively, the recliner 22 can be an inflatable recliner 22 that is made of a soft flexible material (such as PVC, among others), and provided with a hollow interior and an air inlet (not shown) provided in the seat portion 26, back rest 28, or side arm rests 30 and 32 for allowing air to be introduced into the hollow interior to inflate the recliner 22.

The seat portion 26 and back rest 28 can be provided with transverse grooved linings 34 to provide friction that prevents the user from slipping along the seat portion 26 and back rest 28 when the user is seated on the recliner 22. The back rest 28 is angled at a predetermined angle with respect to the seat portion 26, but the actual angle of back rest 28 with respect to the horizontal plane HP (see FIG. 4) that defines the water or a surface can be adjusted by the positioning of the support 24 in the manner explained below.

Each side wall 36 and 38 of the side arm rests 30 and 32, respectively, can be provided with any number (i.e., one or more) of side connectors 40. In addition, a plurality of connectors 42 can also be provided at the rear surface 44 of the back rest 28 and/or the rear surface 46 and 48 of the side arm rests 30 and 32, respectively. The connectors 40 and 42 can have the same structure as any of the configurations illustrated in connection with FIGS. 5 and 7–11 below.

Figure 2:
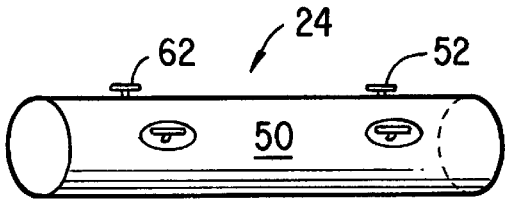
FIG. 2 is a perspective view of a support that can be used with the assembly of FIG. 1.

The support 24 is illustrated in FIG. 2, and has a generally cylindrical shape having a length that has about the same or smaller dimension as the width W of the recliner 22. Although illustrated as having a generally cylindrical shape, the support 24 can be provided in any desired shape or configuration. The support 24 can be formed from one integral piece of foam or other similar material that has sufficient buoyancy to float. Alternatively, the support 24 can be inflatable and made of a soft flexible material (such as PVC, among others), and provided with a hollow interior and an air inlet (not shown) for allowing air to be introduced into the hollow interior to inflate the support 24. One or more connectors 52 are also provided in spaced-apart manner on the cylindrical surface 50 of the support 24.

As illustrated in FIGS. 3 and 4, the plurality of connectors 42 are spaced apart vertically along the rear of the recliner 22, with each pair of connectors 42 horizontally aligned. Any pair of these horizontally-aligned connectors 42 can be used to couple or connect a pair of connectors 52 from the support 24. For example, if the pair 42*a* is used, the support 24 would be coupled to the back rest 28 at a vertically higher level, so that the angle A (see FIG. 4) between the back rest 28 and the horizontal plane HP is smaller than when the support 24 is coupled to the pair 42*b*. In the latter situation, the support 24 would be coupled to the back rest 28 at a vertically lower level, so that the angle A between the back rest 28 and the horizontal plane HP would be greater. Thus, by selecting the desired pair of connectors 42 on the rear of the recliner 22 for coupling the support 24, the user can adjust the angle A between the back rest 28 and the horizontal plane HP to the desired comfort of the user.

Figure 5:
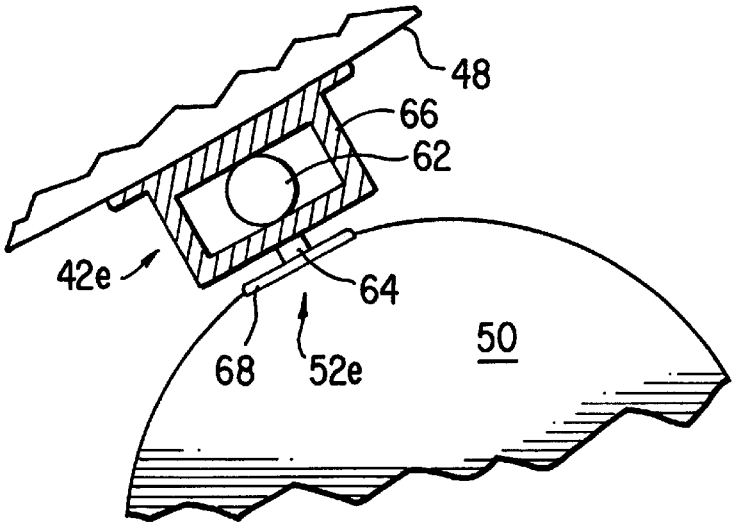
FIGS. 5 and 6 are side views of connectors according to different embodiments of the present invention.

The structure of the connectors 42 and 52, and the resulting connection systems, are illustrated in connection with FIGS. 5–10. A first embodiment is shown in FIG. 5, with the connector 42 forming a female connector 42*e* and the connector 52 forming a male connector 52*e*. In FIG. 5, the female connector 42*e* defines a small housing 66 which has an elongated opening 60 (see FIG. 3). The male connector 52*e* has an elongated bar 62 (see FIG. 2) that is coupled to the cylindrical surface 50 via a tie 64 and a base 68 that is secured to the surface 50. To effectuate the connection between connectors 42*e* and 52*e*, the bar 62 is inserted through the opening 60 and then turned about ninety degrees so that the bar 62 is completely retained inside the housing 66 of the female connector 42*e* to secure and complete the connection.

Figure 6:
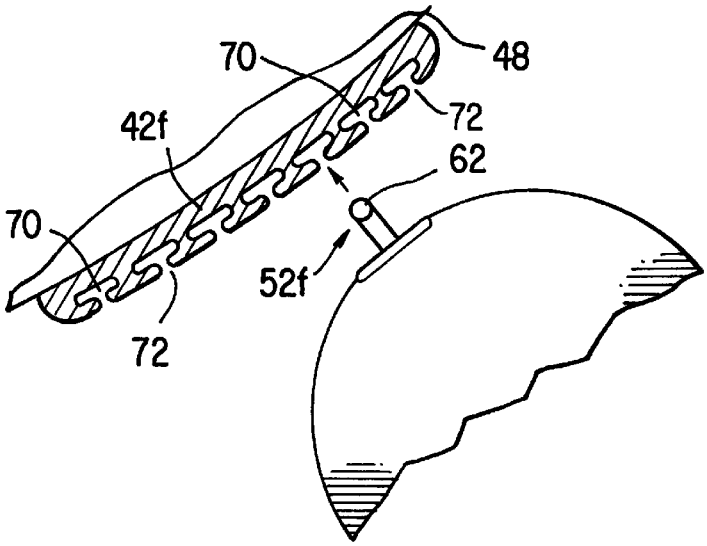

FIG. 6 illustrates another connection system in which the male connector 52*f* can be the same as the male connector 52*e* of FIG. 5. The female connector 42*e* is replaced by a connection plate 42*f* that includes a plurality of grooves 70 accessed by corresponding narrowed openings 72, each of which is smaller in dimension than the corresponding groove 70. The plate 42*f* can be a plastic piece that is welded, glued or otherwise secured to the surfaces 44, 46 and 48 of the recliner 22. In use, each bar 62 of the male connector 52*f* is inserted through a selected opening 72 and retained inside the groove 70 of the plate 42*f* to secure and complete the connection. The benefit provided by the connection plate 42*f* is that a large number of openings 72 and grooves 70 can be provided, and at small incremental distances apart from each other, so as to provide the user with greater flexibility in adjusting the angle A between the back rest 28 and the horizontal plane HP.

Figure 7A:
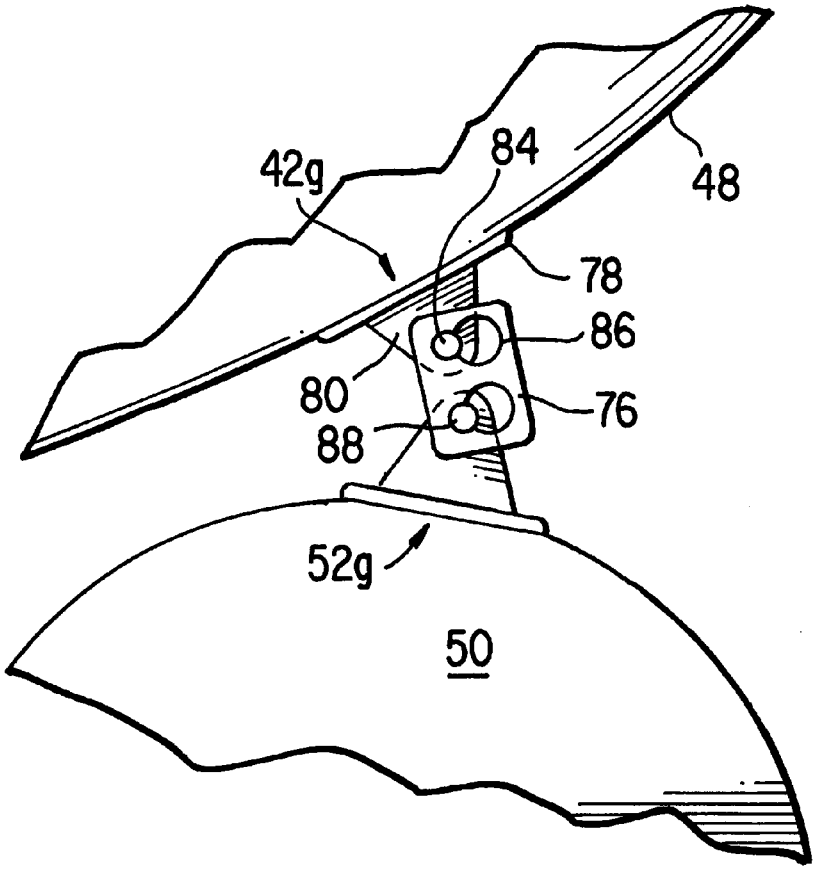
FIG. 7A is an exploded side view of a connector according to another embodiment of the present invention.
Figure 7B:
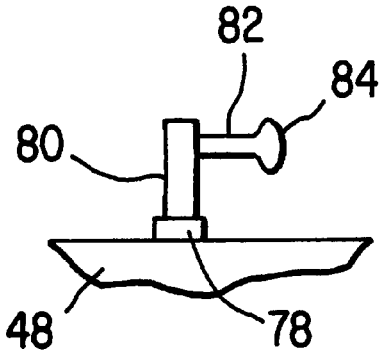
FIG. 7B is a cross-sectional side view of a portion of the connector of FIG. 7A.

FIGS. 7A and 7B illustrate yet another connection system in which the connectors 42*g* and 52*g* can have the same configuration, and are coupled together by a plate 76. Each connector 42*g* and 52*g* has a base 78 with an extension 80 extending radially from the surface 48 and 50, respectively. A bar 82 extends perpendicularly from a side of each extension 80, and has an enlarged end 84. The plate 76 has two sets of two adjoining openings (i.e., each opening opens into the other opening). Each set of adjoining openings includes a first large opening 86 whose diameter is larger than the diameter of the enlarged end 84, and a second small opening 88 whose diameter is larger than the diameter of the bar 82, but smaller than the diameter of the enlarged end 84. To effectuate the connection, the bar 82 of each connector 42*g* and 52*g* is inserted through a corresponding first opening 86 of one of the sets of openings in the plate 76, and then slid to the second opening 88. Therefore, the bar 82 is retained in the second opening 88, but the enlarged end 84 prevents the bar 82 from being disengaged from the second opening 88. To disengage the connection, the user slides the bar 82 back into the first opening 86 and then removes the enlarged end 84 from the first opening 86.

Figure 8:
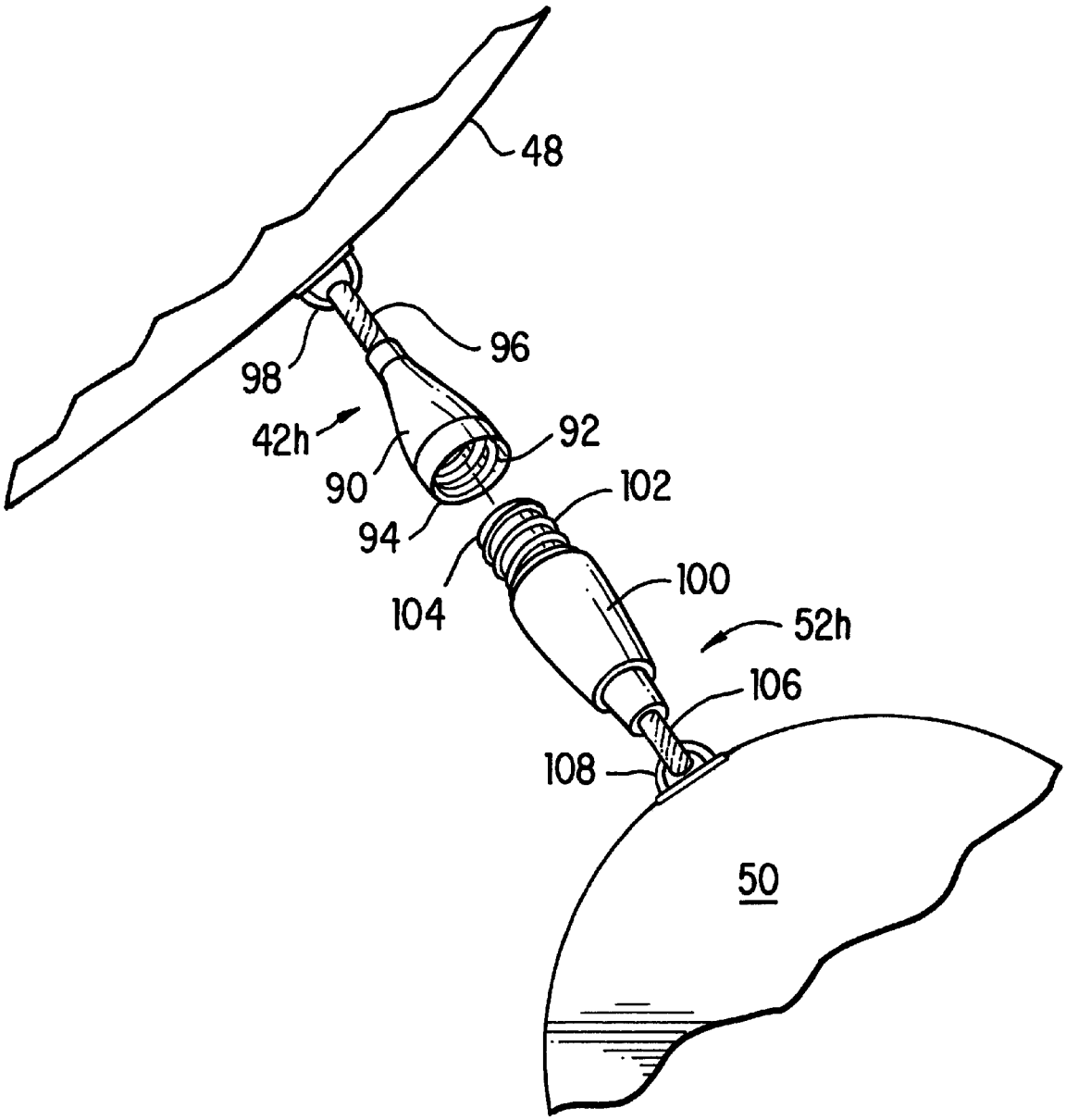
FIGS. 8 and 9 are side views of connectors according to other different embodiments of the present invention.

FIG. 8 illustrates yet another connection system in which the connector 42 forms a female connector 42*h* and the connector 52 forming a male connector 52*h*. In FIG. 8, the female connector 42*h* has a generally cylindrical housing 90 having a hollow interior that has internal threads 92 provided adjacent its outer opening 94. The housing 90 is coupled to the surface 48 of the recliner 22 by a string 96 that is tied to both the housing 90 and to a loop 98 that is secured to the surface 48. The male connector 52*h* has a generally cylindrical housing 100 having external threads 102 provided adjacent its outer end 104. The housing 100 is coupled to the surface 50 of the support 24 by a string 106 that is tied to both the housing 100 and to a loop 108 that is secured to the surface 50. To effectuate the connection, the threads 92 and 102 are rotatably engaged to connect the connectors 42*h* and 52*h*. The threads 92 and 102 can be rotatably disengaged to disconnect the connectors 42*h* and 52*h*.

Figure 9:
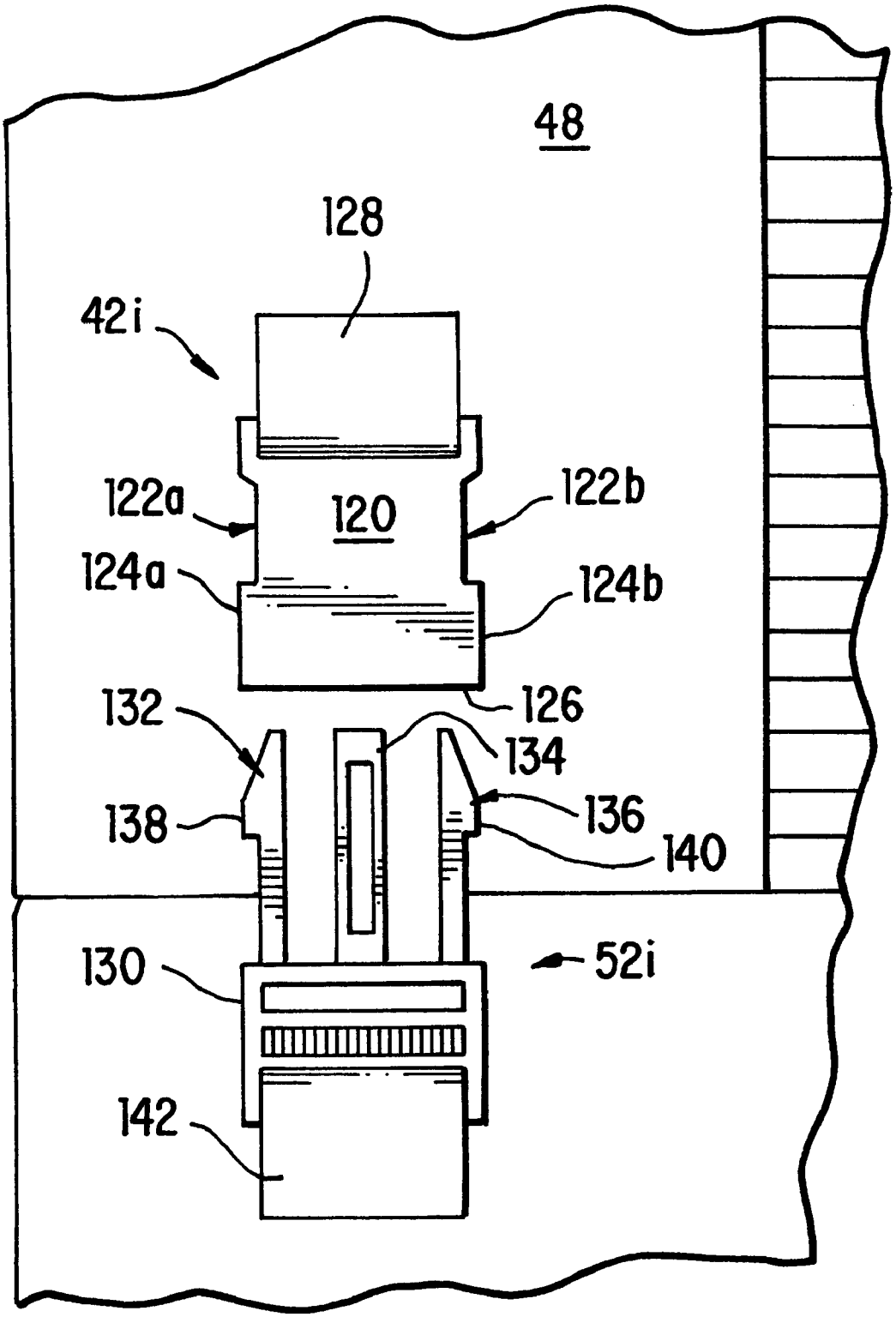

FIG. 9 illustrates yet another connection system in which the connector 42 forms a female bucket-type connector 42*i* and the connector 52 forming a male bucket-type connector 52*i*. In FIG. 9, the female connector 42*i* has a housing 120 that has an opening 122*a*, 122*b* provided on each side wall 124*a*, 124*b*, and an opened outer end 126. The housing 120 is coupled to the surface 48 of the recliner 22 by a PVC or other strip 128 that is connected to both the housing 120 and the surface 48. The male connector 52*i* has a buckle 130 with three prongs 132, 134, 136 extending therefrom. The outside prongs 132 and 136 are flexible, and each has an enlarged end 138 and 140, respectively, so that the combined width of the buckle 130 from one enlarged end 138 to the other enlarged end 140 is greater than the width of the opened end 126. The buckle 130 is coupled to the surface 50 of the support 24 by a PVC or other strip 142 that is connected to both the buckle 130 and the surface 50. To effectuate the connection, the outside prongs 132, 136 are flexed inwardly towards the central prong 134 to reduce the combined width of the prongs 132, 134, 136, which are then inserted through the opened end 126. When the prongs 132, 134, 136 are fitted inside the housing 120, the outside prongs 132, 136 will naturally bias outwardly through the openings 122*a*, 122*b*, respectively, with the enlarged ends 138, 140 engaging the side walls 124*a*, 124*b*, respectively, to securely retain the prongs 132, 136 inside the housing 120. To disconnect, the user presses the enlarged ends 138, 140 inwardly towards the central prong 134 to reduce the combined width of the prongs 132, 134, 136, so that the prongs 132, 134, 136 can be removed from the confines of the housing 120 via the opened outer end 126.

Figure 10B:
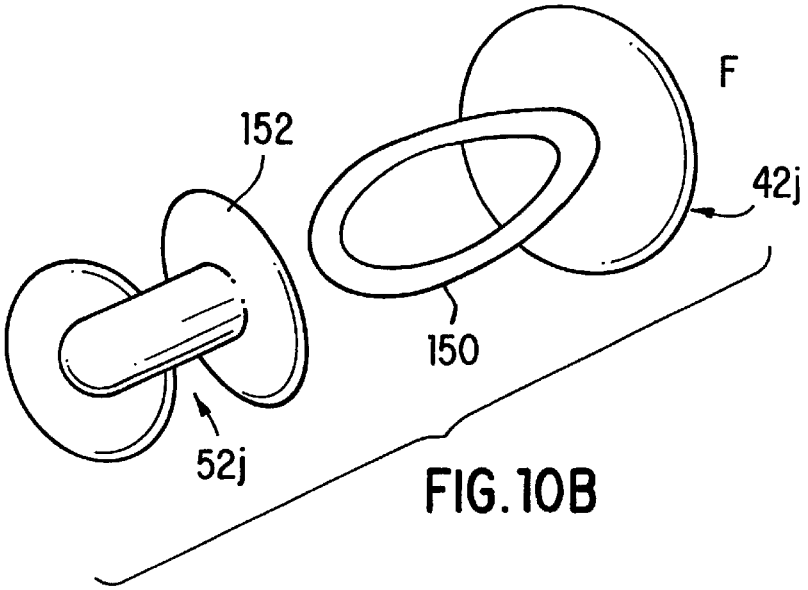
FIG. 10B is an exploded side view of a portion of the connector of FIG. 10A.
Figure 10A:
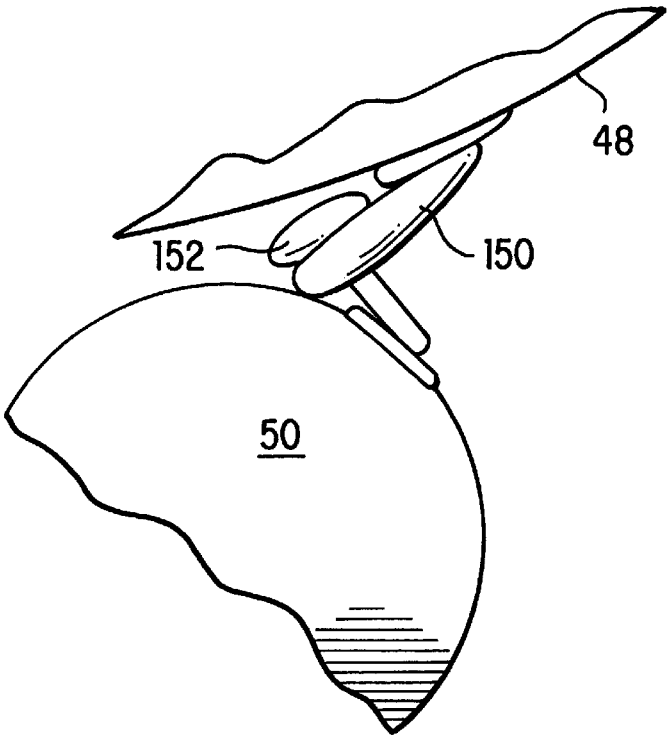
FIG. 10A is a side view of a connector according to yet another embodiment of the present invention.

FIGS. 10A and 10B illustrate yet a further connection system in which the connector 42 forms a female connector 42*j* and the connector 52 forming a male connector 52*j*. The female connector 42*j* has a loop 150 that has an opening. The loop 150 is secured to the surface 48 of the recliner 22. The male connector 52*j* has a tie bar 152 that is secured to the surface 50 of the support 24. The tie bar 152 has a width that has a greater dimension than the diameter of the opening of the loop 150. To effectuate the connection, the tie bar 152 is simply inserted through the opening of the loop 150, as shown in FIG. 10A.

Figure 11:
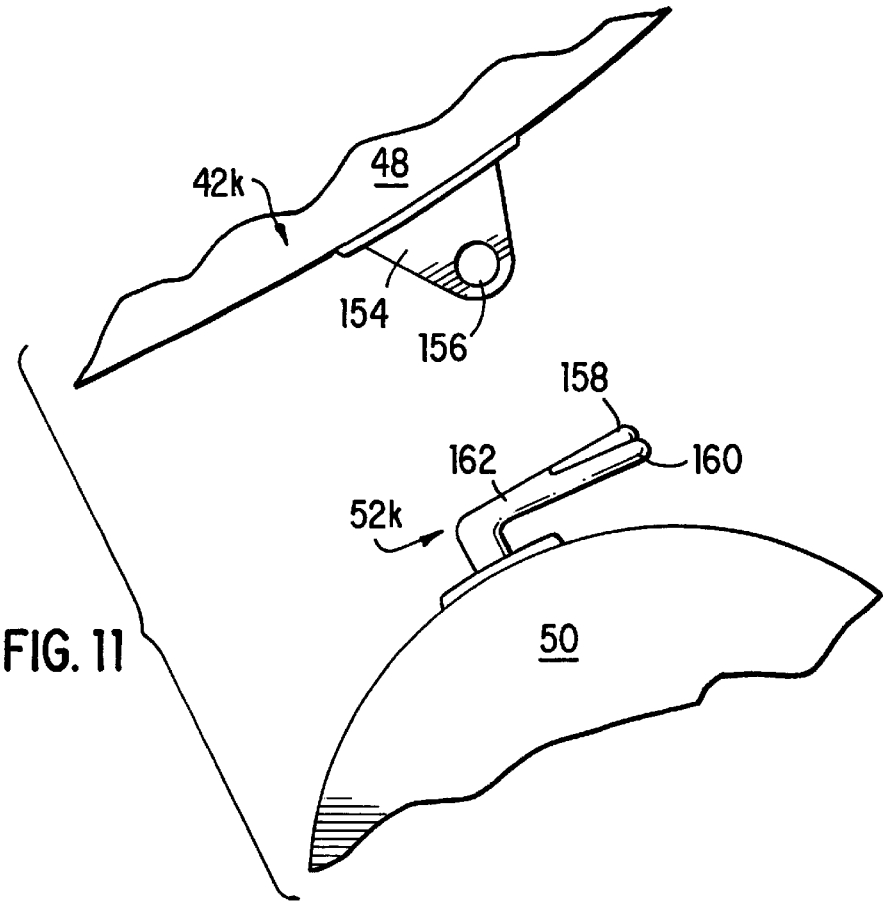
FIG.11 is an exploded side view of a connector according to yet another embodiment of the present invention.

FIG. 11 illustrates yet another connection system in which the connector 42 forms a female connector 42*k* and the connector 52 forming a male connector 52*k*. The female connector 42*j* has a plate 154 that has an opening 156 provided thereon. The plate 154 is secured to the surface 48 of the recliner 22. The male connector 52*k* has two parallel bars 158, 160 that are secured to and extend from a support 162. The support 162 is secured to the surface 50 of the support 24. The bars 158 and 160 can be made from a bendable material, such as aluminum or soft plastic. To effectuate the connection, the bars 158 and 160 are inserted through the opening 156, and then each bar 158 and 160 is bent sideways to secure the bars 158, 160 to the plate 154.

Figure 13:
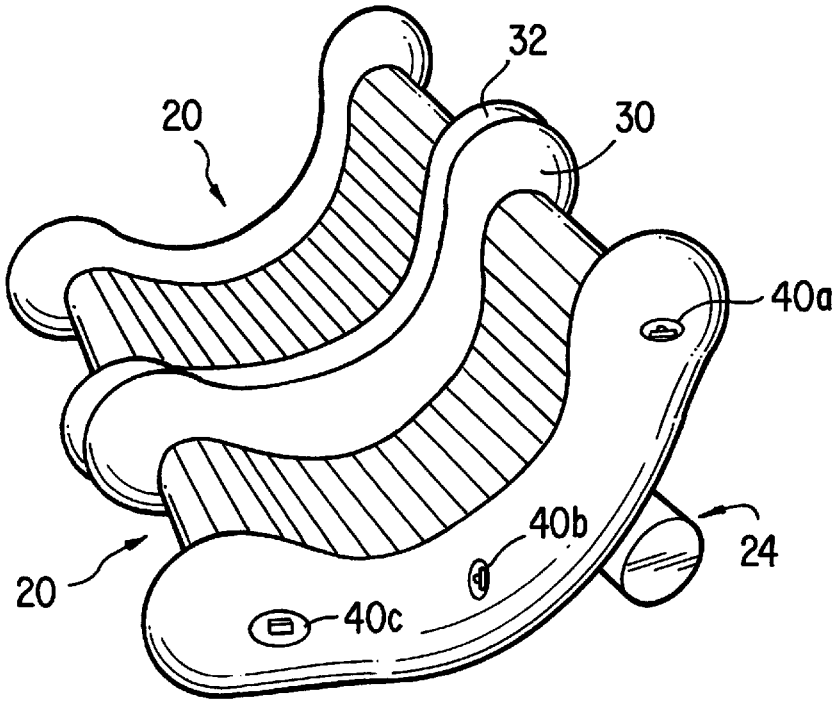
FIG. 13 illustrates two of the assemblies of FIG. 1 coupled in a side-by-side manner.

Any of the connector systems illustrated in FIGS. 5 and 7–11 can be utilized for the side connectors 40. The side connectors 40 can be used to couple the side connectors 40 of an adjacent recliner assembly 20. In particular, referring to FIGS. 3 and 4, two of the side connectors 40*a* and 40*b* on the side wall 32 can be male connectors, with one side connector 40*c* on the side wall 32 being a female connector. Similarly, two of the side connectors 40*d* and 40*e* on the side wall 30 can be female connectors, with one side connector 40*f* on the side wall 30 being a male connector. As a result, as shown in FIG. 13, the female connectors 40*d* and 40*e* on the side wall 30 of a first assembly 20 can be coupled to the male connectors 40*a* and 40*b* on the side wall 32 of a second assembly 20, and the female connector 40*c* on the side wall 32 of the second assembly 20 can be coupled to the male connector 40*f* on the side wall 30 of the first assembly 20, to couple two identical recliner assemblies 20 in a side-by-side manner.

Figure 12:
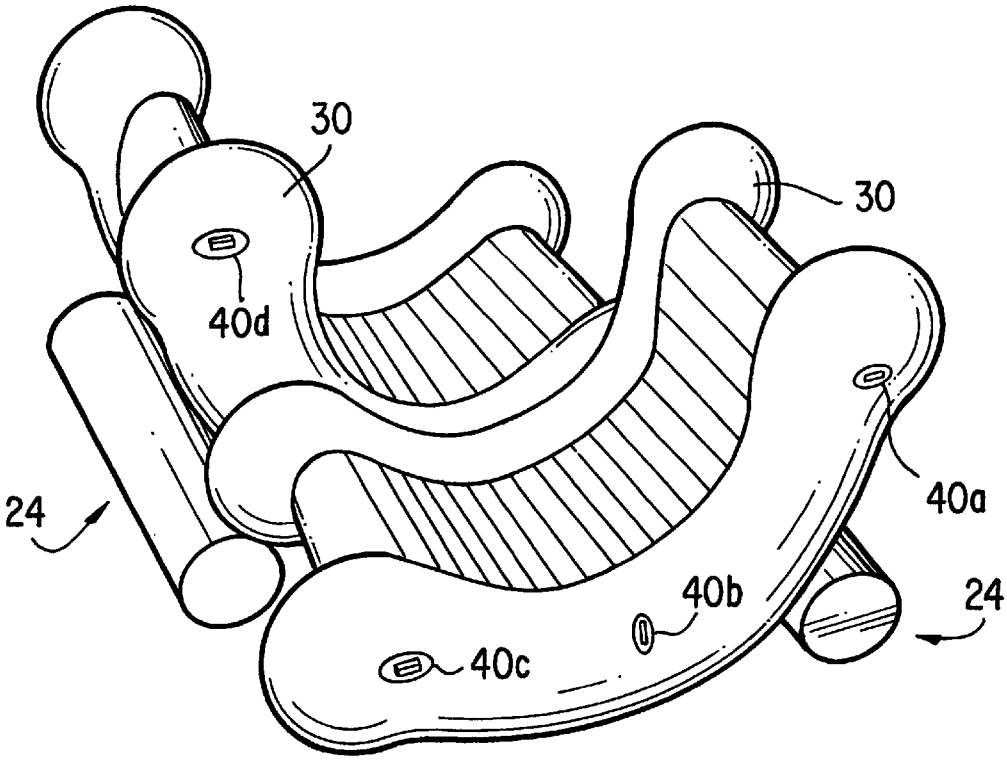
FIG. 12 illustrates two of the assemblies of FIG. 1 coupled in a face-to-face manner.

As another example, referring to FIG. 12, the female connector 40*e* on the side wall 30 of a first assembly 20 can be coupled to the male connector 40*f* on the side wall 30 of a second assembly, to couple two identical recliner assemblies 20 in a face-to-face manner. Therefore, each recliner assembly 20 can be modular in that each assembly 20 is provided in the same configuration, so that a plurality of these assemblies 20 can be combined in different ways (i.e., side-by-side or face-to-face, or any other type connection afforded by the location and structure of the connectors).

While the connectors 42 in FIGS. 5–11 are illustrated as being female connectors and the connectors 52 in FIGS. 5–11 are illustrated as being male connectors, it is possible to reverse any of the connectors 42 and 52 shown in FIGS. 5–11. For example, the female connectors 42 can be coupled to the support 24, and the male connectors 52 can be coupled to the recliner 22.

Thus, the recliner assembly 20 according to the present invention is very easy and convenient to use. The recliner assembly 20 can have the angle of its back rest conveniently adjusted to maximize the comfort of the user. In addition, the portable recliner assembly 20 of the present invention can also be coupled in a variety of different ways to other portable recliner assemblies 20.

While the description above refers to particular embodiments of the present invention, it will be understood that many modifications may be made without departing from the spirit thereof. The accompanying claims are intended to cover such modifications as would fall within the true scope and spirit of the present invention.

What is claimed is:

1. A recliner assembly, comprising:

a first recliner seat having first and second side walls, and first and second connectors provided on the first and second side walls, respectively, the first recliner seat further including a third connector;

a first inflatable support having a support connector that is coupled to the third connector;

a second recliner seat having third and fourth side walls, and fourth and fifth connectors provided on the third and fourth side walls, respectively, the second recliner seat further including a sixth connector; and a second inflatable support having a support connector that is coupled to the sixth connector;

wherein the first recliner seat is connected in a side-by-side manner to the second recliner seat.

2. The assembly of claim 1, wherein the first recliner seat has a rear surface, and the first inflatable support is coupled to the rear surface of the recliner seat.

3. The assembly of claim 1, further including a plate with two sets of two adjoining openings, with a first adjoining opening being larger than a second adjoining opening, and wherein the first and second connectors each comprises an extension with a bar extending perpendicularly therefrom, the bar having an enlarged end.

4. The assembly of claim 1, wherein the first connector of the first recliner seat is coupled to the fourth connector of the second recliner seat.

5. The assembly of claim 1, wherein the first connector of the first recliner seat is coupled to the fifth connector of the second recliner seat.

6. The assembly of claim 1, wherein the first recliner seat is provided in one piece, and the second recliner seat is provided in one piece.

7. The assembly of claim 1, wherein the third connector comprises a plurality of spaced-apart third connectors, and wherein the support connector of the first inflatable support is selectively coupled to one of the plurality of third connectors.

8. The assembly of claim 7, wherein the first recliner seat has a rear surface, and wherein the plurality of third connectors are vertically spaced apart along the rear surface of the recliner seat.

9. The assembly of claim 8, wherein the plurality of third connectors comprises pairs of aligned third connectors, with each pair being spaced vertically spaced apart along the rear surface of the recliner seat.

10. The assembly of claim 9, wherein each third connector in each pair of third connectors is horizontally spaced apart from the other third connector of the pair.

11. The assembly of claim 1, wherein one of the first and second connectors is a female connector and the other of the first and second connectors is a male connector.

12. The assembly of claim 11, wherein the female connector has a housing and an elongated opening, and the male connector has an elongated bar.

13. The assembly of claim 11, wherein the female connector has a plate that includes a plurality of spaced apart grooves, and a plurality of openings, with each opening communicating with a corresponding groove, and wherein the male connector has an elongated bar.

14. The assembly of claim 11, wherein the female connector has a cylindrical member provided with internal threads, and the male connector has a cylindrical member with external threads.

15. The assembly of claim 11, wherein the female connector has a housing with first and second side openings, and the male connector has first and second flexible prongs.

16. The assembly of claim 11, wherein the female connector has a loop, and the male connector has a tie bar.

17. The assembly of claim 11, wherein the female connector has a plate that includes an opening, and the male connector has a pair of bars.

* * * * *